United States Patent [19]

Hellerich

[11] Patent Number: 4,571,143

[45] Date of Patent: Feb. 18, 1986

[54] MEANS FOR TRANSPORTING AND DELIVERING DRY CHEMICALS

[76] Inventor: Gary L. Hellerich, R.R. 1, Box 131, Valparaiso, Nebr. 68065

[21] Appl. No.: 599,343

[22] Filed: Apr. 12, 1984

[51] Int. Cl.[4] ..... B60F 1/40; B60F 1/64

[52] U.S. Cl. ..... 414/523; 410/68

[58] Field of Search ..... 414/498, 523, 526; 410/68

[56] References Cited

U.S. PATENT DOCUMENTS 2,678,738 5/1954 Mangrum ..... 414/498 X 3,474,935 10/1969 McKinney ..... 414/498 X 3,478,968 11/1969 McKinney ..... 414/498 X

*Primary Examiner*—Robert G. Sheridan

*Attorney, Agent, or Firm*—Zarley, McKee, Thomte, Voorhees & Sease

[57] ABSTRACT

An apparatus for transporting, storing and delivering dry chemicals to a planter apparatus is described comprising a support frame mounted on the bed of a truck and a chemical tank removably mounted thereon. The tank is filled with the chemical at the chemical plant and the chemical is conveyed from the tank to the planter apparatus to fill the chemical hoppers thereon. When the tank becomes empty, the tank is replaced with a full tank.

4 Claims, 6 Drawing Figures

MEANS FOR TRANSPORTING AND DELIVERING DRY CHEMICALS

BACKGROUND OF THE INVENTION

Dry chemicals such as insecticides, herbicides and fungicides are frequently applied to fields during the planting operation. Many planters have chemical hoppers positioned behind the seed hoppers and which are designed to deposit or apply the dry chemicals onto or into the ground behind the planter.

The handling of the dry chemicals is quite hazardous and it is highly desirable to avoid contact with the chemicals. This is troublesome since the chemicals are normally placed in the chemical hoppers by one of two means. One method of providing the dry chemicals to the hopper is by individual bags which are opened and the contents thereof poured into the hopper. A further method is to permanently mount a chemical hopper on a truck or trailer and auger or otherwise convey the dry chemicals to the planter equipment. The first method described above is extremely hazardous since the operator is constantly brought into contact with the dry chemicals. The second method also presents some hazard since the tank must be filled at some point in the operation. With respect to a second method, it would therefore be highly desirable if the chemical tank could be filled at the chemical manufacturing plant and then transported to the ultimate point of use. A problem with this particular method is that the chemical tanks must be strong enough to survive the rigors of transportation but yet light enought to avoid large freight costs.

Therefore, it is a principal object of the invention to provide an improved means for transporting dry chemicals.

A further object of the invention is to provide a means for transporting dry chemicals including means for conveying or delivering the dry chemicals to chemical applicators.

A further object of this invention is to provide a means for transporting and delivering dry chemicals which substantially eliminate all exposure to the chemicals.

Yet another object of the invention is to provide a means for transporting and delivering dry chemicals wherein a relatively lightweight chemical tank is employed and which is adapted to be secured to a permanent support means mounted on a wheeled frame means such as a truck or trailer.

These and other objects will be apparent to those skilled in the art.

SUMMARY OF THE INVENTION

Figure 2:
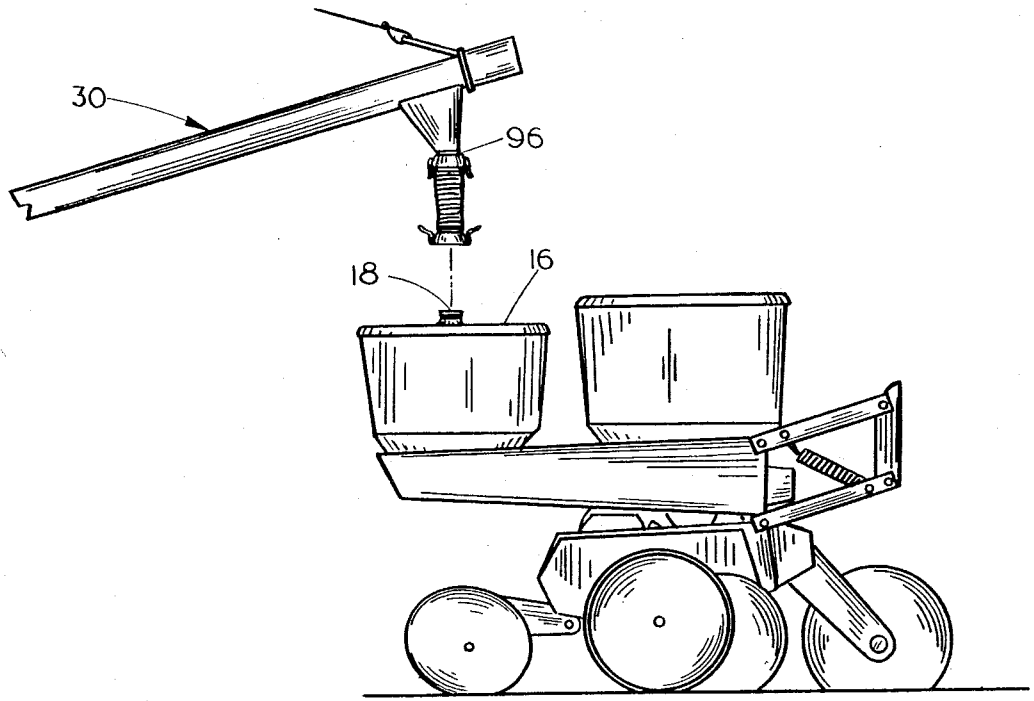
FIG. 2 is a partial side view illustrating the discharge end of the conveyor about to be connected to the lid on the chemical hopper.

A support frame comprising a pair of spaced-apart beams is permanently secured to the bed of a truck or trailer. A chemical tank is adapted to be removably mounted on the support frame means and includes a tank having a plurality of support legs and braces extending downwardly therefrom. The chemical tank has a discharge spout provided at the lower end thereof which is adapted to receive the intake end of a discharge conveyor. The chemical tank is filled with the dry chemicals at the chemical plant and is transported to various field locations. The supporting legs and braces on the tank support the tank during the transportation period. The filled chemical tank is positioned upon the support frame means and secured thereto by straps or the like to maintain the tank on the support frame means. When it is desired to fill the chemical hoppers on the planter apparatus, the truck is driven adajacent the planter and the auger is employed to convey dry chemicals from the tank to the chemical hoppers. When the chemical tank becomes empty, it may be replaced by a filled tank.

DESCRIPTION OF THE PREFERRED EMBODIMENT

In the drawings, the numeral 10 refers to a conventional planter apparatus which is pulled through the field by a conventional tractor 12. Planter apparatus 10 includes a plurality of chemical hoppers 14 having modified lids or covers 16 provided thereon. Each of the covers 16 include an upwardly extending connector or fitting 18 as will be described in more detail hereinafter.

The numeral 20 refers to a wheeled frame means such as a truck or trailer and which has a bed 22 mounted thereon. The apparatus of this invention is referred to generally by the reference numeral 24 and comprises a support frame means 26 which is permanently secured to the bed 22 and a chemical tank 28. The numeral 30 refers to a conveyor means adapted to convey the chemicals from the tank 28 to the planter apparatus as will be described hereinafter.

Figure 3:
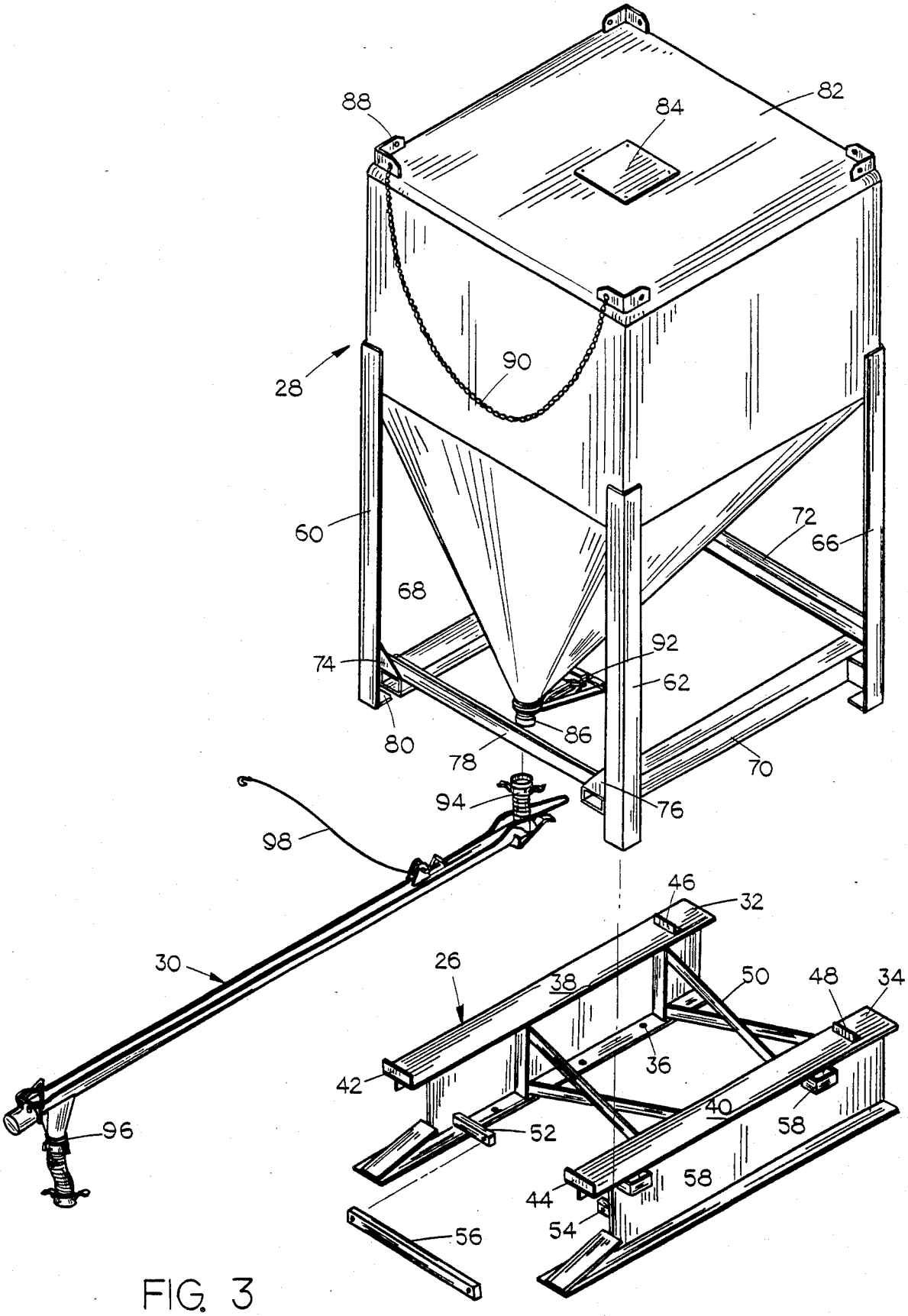
FIG. 3 is an exploded perspective view illustrating the relationship of the chemical tank, support means and chemical conveyor.
Figure 5:
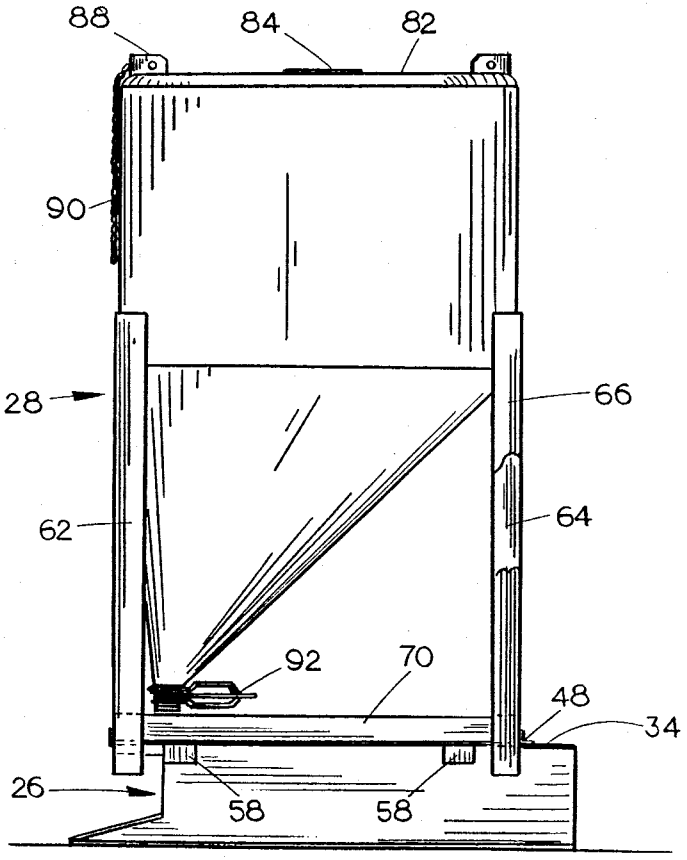
FIG. 5 is a side view of the chemical tank and support means.

Support frame means 26 comprises a pair of spaced-apart beams 32 and 34 which are bolted or otherwise secured to the bed 22 of the truck 20. As seen in FIG. 3, the beams 32 and 34 are provided with openings 36 through which bolts may be extended to secure the beams to the bed of the truck. Beams 32 and 34 include horizontally disposed upper surfaces 38 and 40 respectively. Beams 32 and 34 are provided with upwardly extending flanges 42 and 44 respectively and upwardly extending brackets 46 and 48 inwardly of the other end thereof. A plurality of braces 50 are secured to the beams 32 and 34 and extend therebetween as seen in FIG. 3. Bars 52 and 54 are secured to beams 32 and 34 as seen in FIG. 3 and have bar 56 secured thereto by any convenient means such as bolts or the like so as to extend therebetween. Each of the beams 32 and 34 are provided with a pair of U-shaped members 58 to enable the tank 28 to be secured thereto as will be explained hereinafter.

Tank 28 is preferably comprised of a lightweight aluminum and includes four upstanding legs 60, 62, 64 and 66. Tubular member 68 is secured to legs 60 and 64 and extends therebetween adjacent the lower ends thereof. Tubular member 70 is secured to and extends between the legs 62 and 66 adjacent the lower ends thereof. Brace 72 is secured to legs 64 and 66 and tubes 68 and 70 and extends therebetween. Gusset plate 74 is welded to leg 60 and tube 68 while gusset plate 76 is welded to leg 62 and tube 70. Brace 78 is welded to the gusset plates 74 and 76 and legs 60 and 62 and extends therebetween. Similarly, gusset plates are provided on legs 64 and 66. As seen in the drawings, each of the support legs 60, 62, 64 and 66 have horizontally extending foot portions 80 provided thereon.

Tank member 82 is hollow and is sealed except for the closable opening 84 at its upper end and the discharge spout means 86 at its lower end. Brackets 88 are provided at the upper end of the tank member 82 at the corners thereof adapted to receive chains 90 or the like to enable the tank to be lifted from its supporting surface or from the support frame means 26. Discharge spout 86 may be opened or closed by means of the conventional mechanism 92 mounted thereon.

Conveyor means 30 may be either a hydraulic or electrical motor operated auger such as seen in the drawings or a pneumatic conveyor. Conveyor 30 includes an intake connector 94 which is adapted to be removably secured to the discharge spout 86. Conveyor 30 includes a discharge spout 96 which is adapted to be connected to the spouts 18 on the covers 16. Winch 98 is provided on the conveyor 30 and is adapted to be connected to the chain 90 to raise and lower the outer end of the conveyor 30 as desired. If desired, the inner end of the conveyor 30 may be detachably secured to the bar 56 to aid in supporting the inner end thereof.

In operation, the support frame means 26 is secured to the bed of the truck or trailer and left thereon during the planting season. The chemical tank 28 is filled with the dry chemicals at the point of manufacture and then shipped to a distribution point. The chemicals are contained within the tank 28 during shipment thereby eliminating any hazardous exposure to persons handling the tanks. The tanks by being constructed of lightweight aluminum reduce freight costs. The tanks are normally transported in the upright position with the support legs 60, 62, 64 and 66 engaging the supporting surface to maintain the tanks in an upright condition. The tanks may be moved by connecting suitable lifting equipment to the brackets 88.

Figure 4:
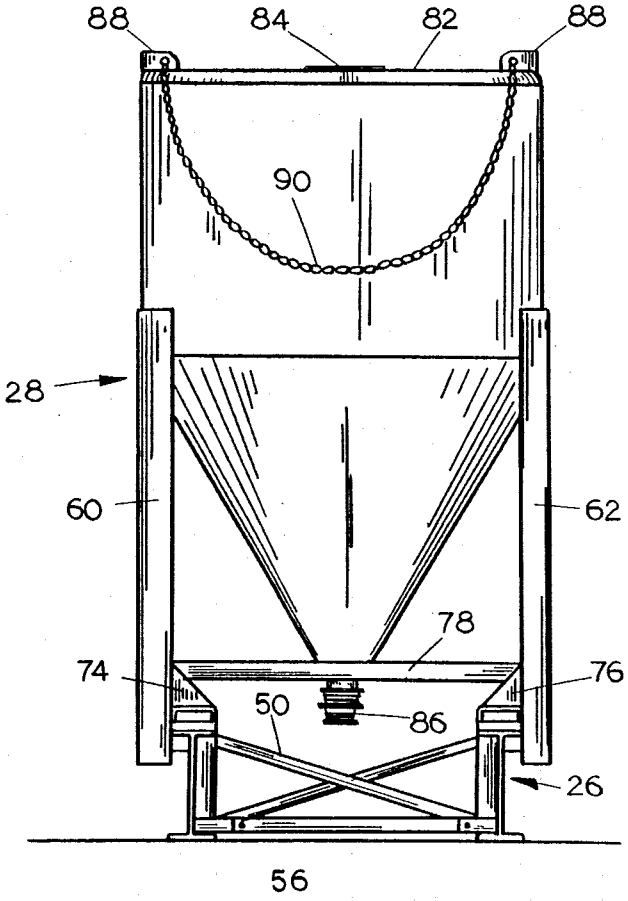
FIG. 4 is a front view of the chemical tank and support means.

When a farmer desires to spread chemicals on his field, he will drive the truck to the distributor, or the distributor will come to the farmer's location. A filled tank 28 is then positioned on the support frame means 26 as illustrated in the drawings. If desired, the distributor could fill the tank while the tank is on the truck. When the tank 28 is positioned on the support frame means 26, the undersides of tubes 68 and 70 rest on the upper surfaces 38 and 40 of beams 32 and 34 between the flanges 42, 44 and brackets 46, 48. The flanges 42, 44 and brackets 46, 48 prevent longitudinal movement of the tank with respect to the support frame means. The lower ends of the support legs 60, 62, 64 and 66 are positioned outwardly of the beams 32 and 34 as illustrated in FIG. 4. Such a relationship prevents lateral movement of the tank with respect to the support frame means. Flexible straps or the like (not shown) are extended over the tank and secured to the members 58 to positively maintain the tank on the support frame means 26.

Figure 1:
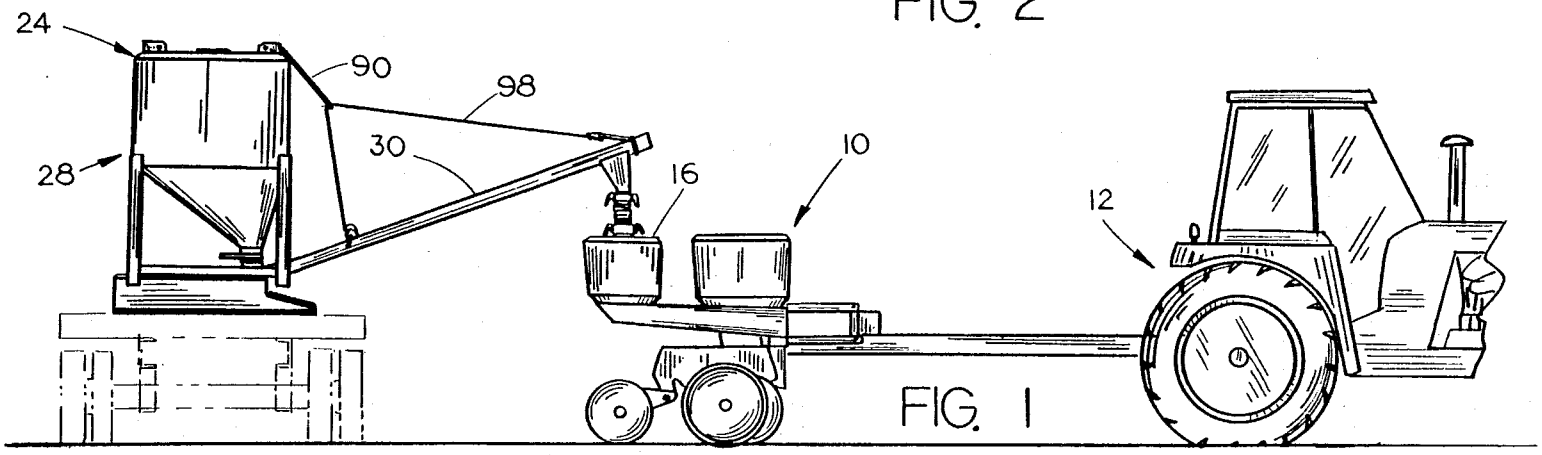
FIG. 1 is a partial side view illustrating the apparatus of this invention being used to deliver dry chemicals to a chemical hopper on a planter apparatus.
Figure 6:
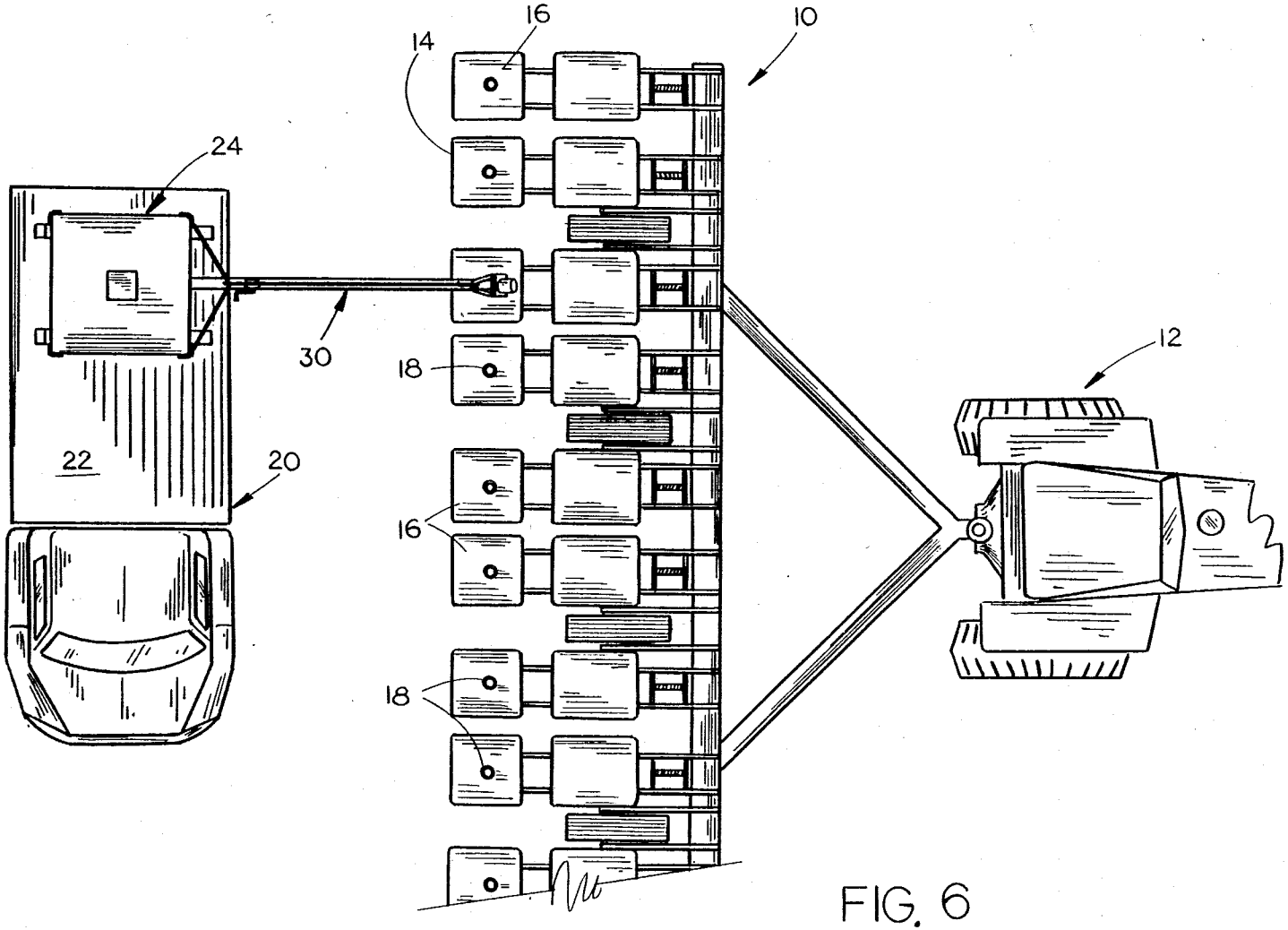
FIG. 6 is a top view illustrating the apparatus of this invention being employed to fill the chemical hoppers on a planter apparatus.

The farmer then drives the truck to the field and drives the truck to a position rearwardly of the planter apparatus 10 as illustrated in FIGS. 1 and 6. The conveyor means 30 is then connected to the discharge spout 86 and the spout 96 is connected to the spout 18 on the endmost cover 16. Valve 92 is then opened and conveyor 30 is activated so that the dry chemical in the tank 28 is conveyed to the interior of the chemical hopper 14. When the chemical hopper 14 has been filled, the conveyor 30 is deactivated. The discharge end of the conveyor 30 is then disconnected from the spout 18 and the spout 18 is closed. Conveyor 30 is then pivoted into position for the adjacent hopper. After the adjacent hopper is filled, the truck is driven forwardly to fill the next pair of chemical hoppers.

When the tank 28 becomes empty, the truck is driven to the distribution point and replaced by a full tank. Thus it can be seen that a novel means has been provided for transporting, storing and delivering dry chemicals to a planter apparatus without the operator being exposed to the dry chemicals. The dry chemicals are kept out of contact with the atmosphere during the transportation, storage and delivering operations thereby substantially reducing the risk of hazardous exposure. Thus it can be seen that the invention accomplishes at least all of its stated objectives.

I claim:

1. In combination, a support frame means for mounting on a wheeled frame means having a flat support bed, said support frame means comprises a pair of spaced-apart beams having bottom edges adapted to lie on the support bed and a pair of raised support surfaces disposed in vertically spaced relation above said bottom edges, a dry chemical supply hopper means selectively removably mounted on and secured to said support frame means and positioned thereabove whereby an empty hopper means may be replaced on said support frame means with a filled hopper means, said hopper means having a chemical discharge means at its lower end, said hopper means further comprising a support leg means having a pair of generally horizontally disposed support members adjacent the lower end thereof, which support members have bottom surfaces positioned for registration with said raised support surfaces upon mounting of said hopper on said support frame means whereby said discharge means is positioned in spaced relation above the bottom edge of the support frame means, coacting abutment means on said support frame means and hopper means for horizontally securing said hopper means in its registered position on the support frame means, and a delivery conveyor means selectively removably connected to said chemical discharge means for conveying the dry chemical outwardly therefrom.

2. The combination of claim 1 wherein said support beams are horizontally disposed.

3. The combination of claim 2 wherein the wheeled frame means comprises a truck having a bed means, said support beams being positioned upon and secured to said bed means.

4. The combination of claim 1 wherein said hopper means is selectively sealed.

* * * * *